US006668420B2

(12) United States Patent
Hannan et al.

(10) Patent No.: US 6,668,420 B2
(45) Date of Patent: Dec. 30, 2003

(54) BRUSH ASSEMBLY REMOVAL DEVICE FOR A FLOOR CLEANER

(75) Inventors: Larry W. Hannan, North Canton, OH (US); Ryan S. Steiner, Dalton, OH (US); Leron R. Thomas, North Canton, OH (US)

(73) Assignee: The Hoover Company, North Canton, OH (US)

( * ) Notice: Subject to any disclaimer, the term of this patent is extended or adjusted under 35 U.S.C. 154(b) by 397 days.

(21) Appl. No.: 09/815,682

(22) Filed: Mar. 23, 2001

(65) Prior Publication Data

US 2002/0133890 A1 Sep. 26, 2002

(51) Int. Cl.[7] ..... A47L 9/04

(52) U.S. Cl. ..... 15/320; 15/49.1; 15/383; 15/385; 15/400

(58) Field of Search ..... 15/49.1, 50.1, 15/98, 179, 383, 385, 398, 400, 320

(56) References Cited

U.S. PATENT DOCUMENTS

| | | | | |
|---|---|---|---|---|
| 1,720,153 A | * | 7/1929 | Simpson | 15/400 |
| 2,130,635 A | * | 9/1938 | Dow et al. | 15/397 |
| 2,276,943 A | * | 3/1942 | Dow | 15/397 |
| 3,683,444 A | | 8/1972 | Schaefer et al. | 15/183 |
| 4,319,379 A | * | 3/1982 | Carrigan et al. | 15/400 |
| 4,610,047 A | * | 9/1986 | Dick et al. | 15/319 |
| 4,720,891 A | | 1/1988 | Rennecker et al. | 15/371 |
| 5,918,340 A | | 7/1999 | Young | 15/115 |
| 6,009,593 A | | 1/2000 | Crouser et al. | 15/320 |

FOREIGN PATENT DOCUMENTS

| | | | |
|---|---|---|---|
| EP | 0 192 943 | * | 9/1986 |
| JP | 1-201221 | * | 8/1989 |

OTHER PUBLICATIONS

Page UD–01 From Service Manual for Bissell Upright Deep Cleaner (Models 1690, 1695) issued Jan., 1998.

Photograph of triangular cap for the dirty tank assembly for the Bissell Upright Deep Cleaner Model 1690, received on Jun. 29, 1998.

Pages 15, 17 & 19 from Owner's Manual For A Kenmore Vacuum Cleaner (Models 116.31732 and 116.31722) received on Nov. 3, 2000.

Photograph of the filter tabs for the filter cover and locking tabs for the agitator cover on Kenmore Vacuum Cleaner (Model 116.31732), received on Nov. 3, 2000.

* cited by examiner

*Primary Examiner*—Terrence R. Till
(74) *Attorney, Agent, or Firm*—A. Burgess Lowe; Brett A. Schenck

(57) ABSTRACT

A cleaner for cleaning a surface is provided comprising a main body and a brush assembly for engaging the surface being cleaned. An engaging member on the main body or brush assembly and a retaining portion on the other main body or brush assembly. The engaging member and retaining portion are releasably connected to each other such that the engaging member or retaining portion is accessible for engagement by a user to disengage the engaging member from the retaining portion.

17 Claims, 4 Drawing Sheets

BRUSH ASSEMBLY REMOVAL DEVICE FOR A FLOOR CLEANER

BACKGROUND OF THE INVENTION

1. Field of the Invention

The present invention relates to a cleaner such as a carpet cleaning device having a powered brush assembly. More particularly, the present application pertains to such a brush assembly that can be easily removed from the nozzle of a carpet extractor.

2. Background Information

It is known in the prior art to provide a carpet extractor having powered brushes to assist in scrubbing of the surface being cleaned. The brush assembly is generally affixed to the main body of the carpet extractor. However, after many times of use, a user may want to remove the brush assembly to clean the brushes or replace them due to the wear and tear of their bristles.

One example of a brush removal device is illustrated by commonly owned U.S. Pat. No. 6,009,593 issued to Crouser. This patent generally comprises an elongate brush support beam having integrally molded, spaced apart, vertically aligned cylindrical bearings each receiving therein a vertically directed axle shaft of an associated rotary scrubbing brush. The brush assembly has outwardly projecting resilient tangs 51 depending from the lower end of gear guard 32A. Each tab snaps into vertically elongated grooves or slots 53 and 57 respectively of lower housing in the base module 10 of the carpet extractor. Each tab has hook portions at its free end that will engage the bottom end of the vertical slot to support the guard and brush support beam. The resilient tabs are pressed inwardly by a user to disengage the hooks from the bottom end of the vertical slot and thus, allow removal of the brush block. However, due to the structure and arrangement of the tangs with respect to the brush block, a user has some difficulty in accessing, grasping, and pressing the tabs inwardly. Often, a tool such as a screwdriver has to used by the user to press the tabs inwardly.

Hence, it is an object of the present invention to provide a brush block having a device that allows it to be easily removed by a user from the cleaner, carpet extractor, or the like.

It is another object of the present invention to provide a simple inexpensive removal device for a brush block of a cleaner, carpet extractor, or the like.

SUMMARY OF THE INVENTION

The foregoing and other objects of the present invention will be readily apparent from the following description and the attached drawings. In one embodiment of the present invention a cleaner for cleaning a surface is provided comprising a main body and a brush assembly for engaging the surface being cleaned. An engaging member on either the main body or brush assembly and a retaining portion on the other main body or brush assembly. The engaging member and retaining portion are releasably connected to each other such that either the engaging member or retaining portion is accessible for engagement by a user to disengage the engaging member from the retaining portion.

BRIEF DESCRIPTION OF THE DRAWINGS

The invention will now be described, by way of example, with reference to the attached drawings, of which.

DETAILED DESCRIPTION OF THE PREFERRED EMBODIMENT

Figure 1:
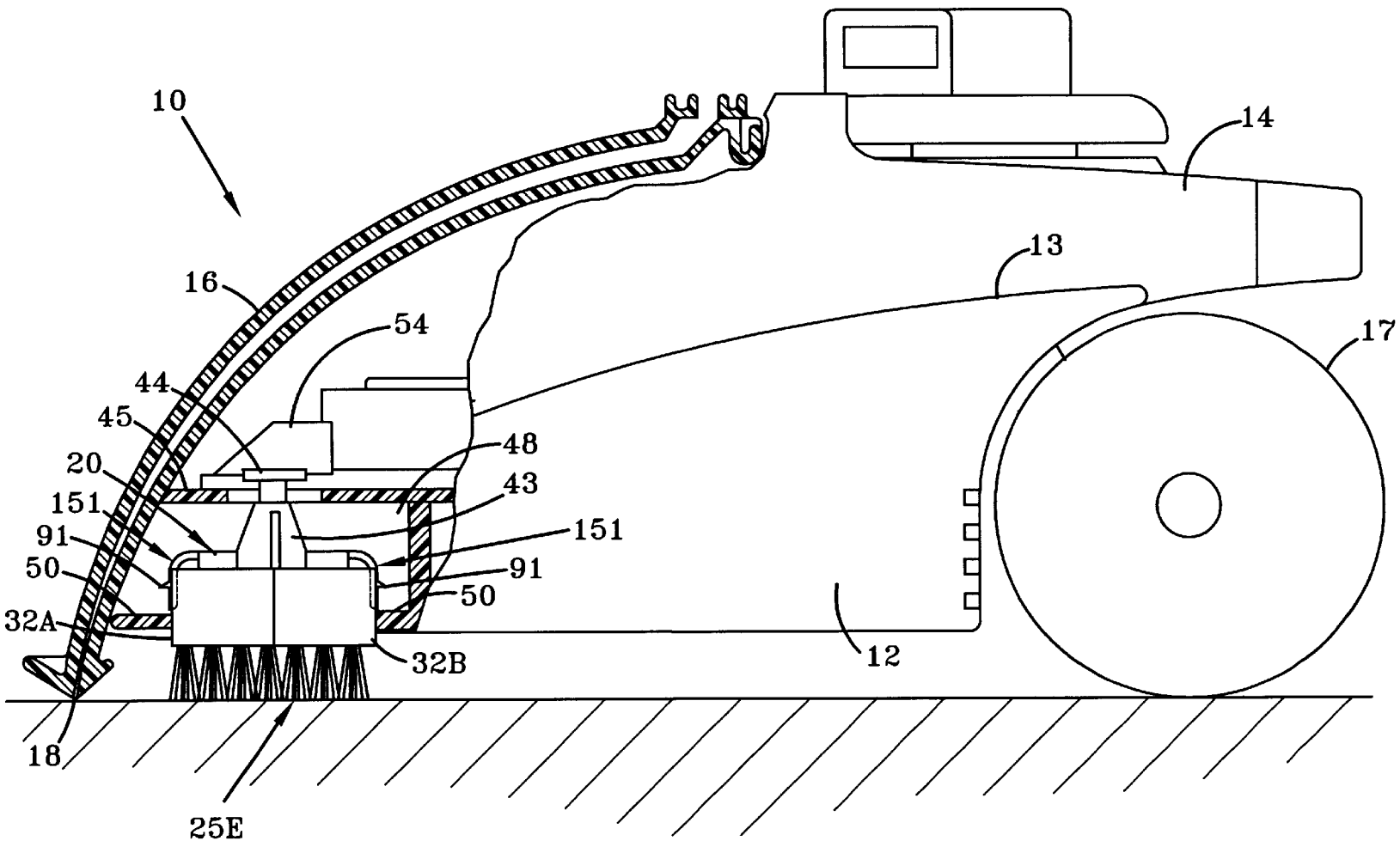
FIG. 1 is a left side elevational view of the base module of an upright cleaner having the forward portion thereof cut away to illustrate the general positioning of the brush assembly therein according to the present invention.
Figure 3:
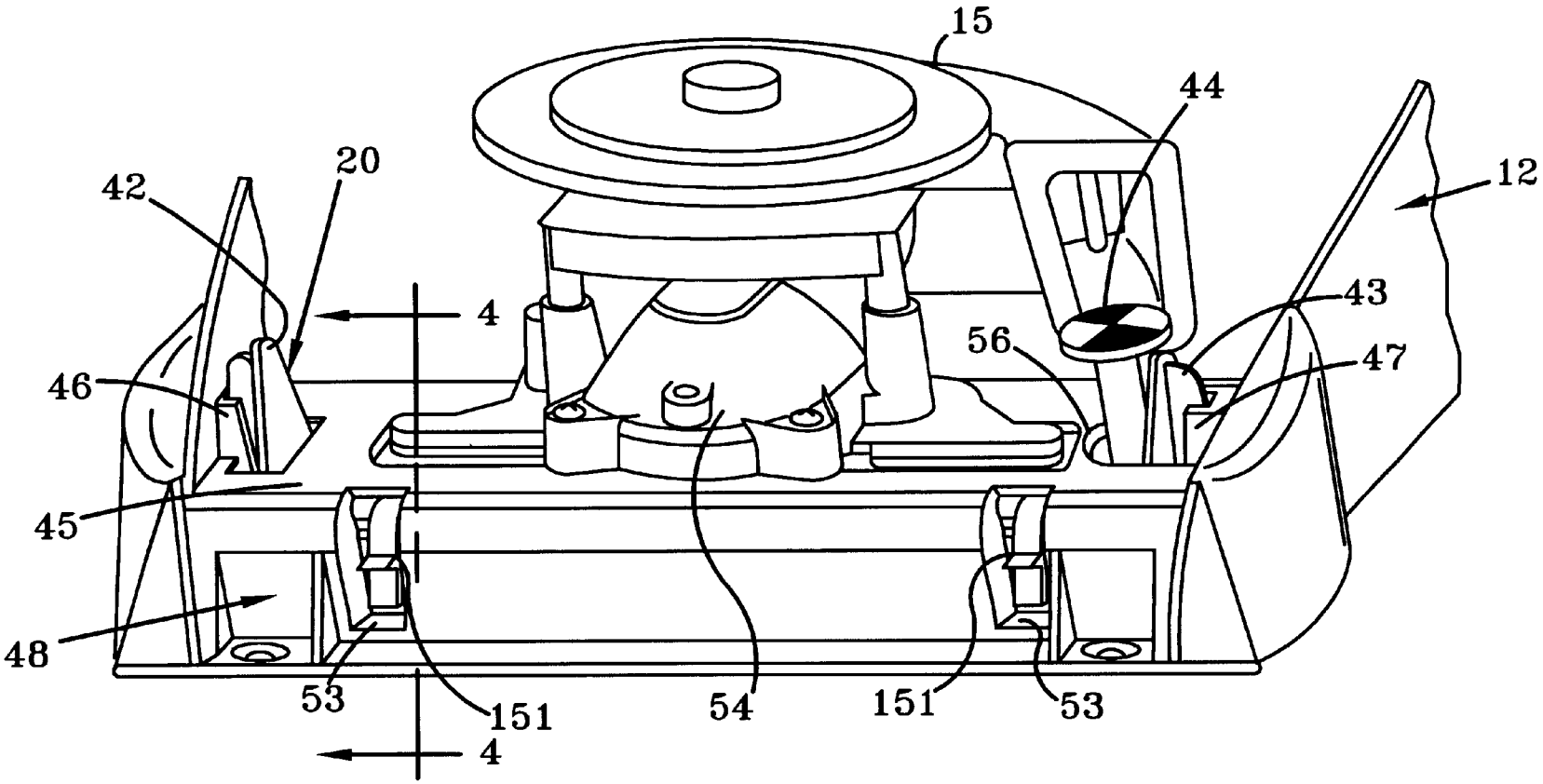
FIG. 3 is a perspective view of the forward portion of the base module illustrated in FIG. 1, having the top cover portion being removed.

In one embodiment of the present invention, a base module 10 for an upright carpet extractor is shown in FIG. 1. The base module is similar to the one found in previously mentioned co-owned U.S. Pat. No. 6,009,593. In general, a base module 10 comprises a lower housing 12 and an upper housing 14 which generally separate along parting line 13. A suction nozzle 16 and a suction inlet 18 are part of the upper housing 14 similar to that taught in the above referenced co-owned patent. A floating carpet scrubbing brush assembly 20 is suspended in the lower housing 12. As depicted in FIG. 3, the brush assembly 20 may be powered by an air driven turbine 15, or any suitable motive power means typically used in the industry, through a suitable gear drive train or transmission 54.

Figure 2:
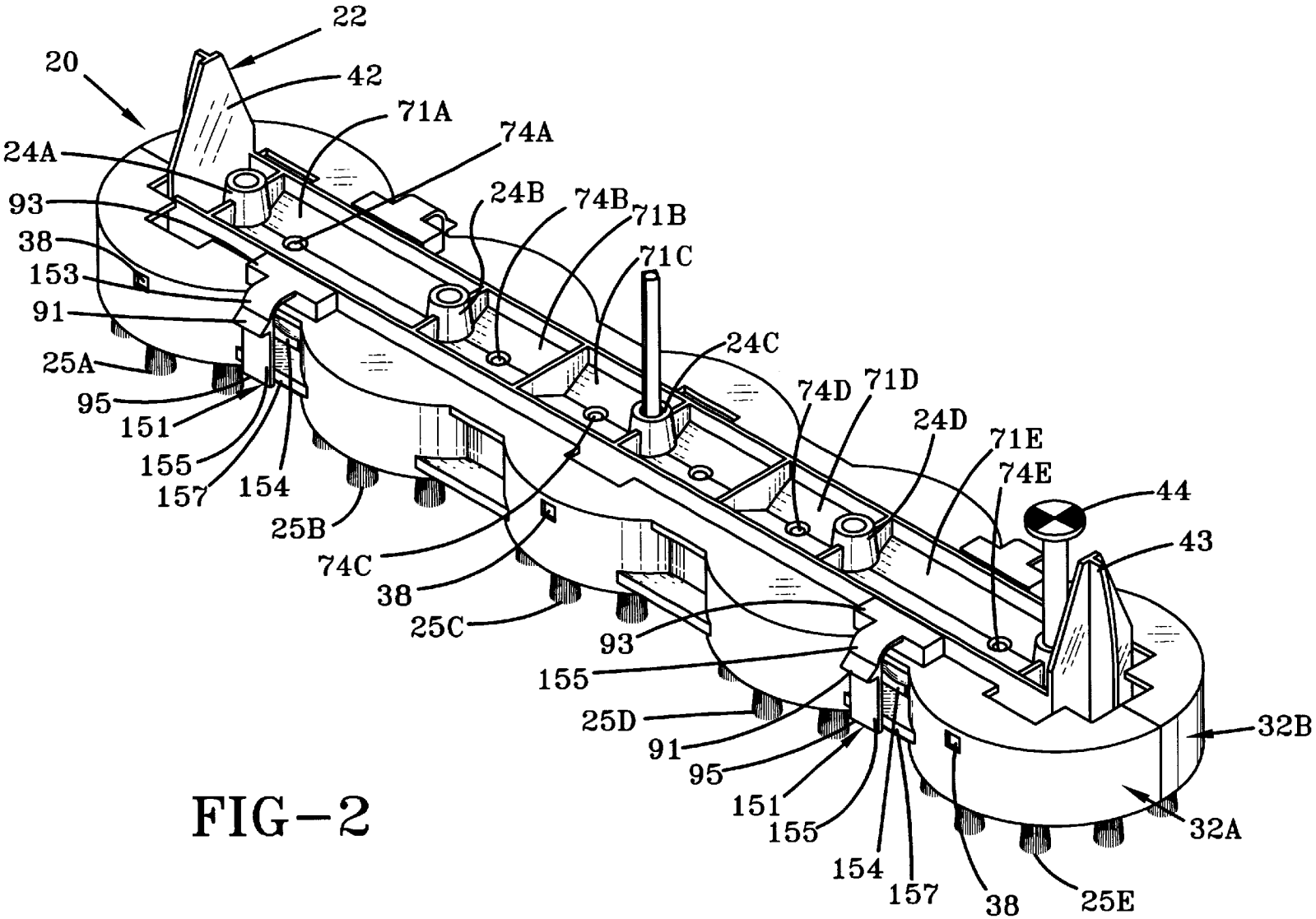
FIG. 2 is a top perspective view of the brush assembly according to the present invention.

As shown in FIG. 2, the brush assembly 20 comprises a brush support beam 22 having five spaced apart integrally molded, cylindrical bearings 24A, 24B, 24C, 24D, and 24E. Rotatingly received within bearings are axial shafts (not shown but illustrated in previously mentioned U.S. Pat. No. 6,009,593; the disclosure of which is incorporated herein by reference) of gear brushes 25A, 25B, 25C, 25D, and 25E. The beam 22 further includes troughs 71A, 71B, 71C, 71D, and 71E, for receiving a cleaning solution. The cleaning solution flows through supply conduits 74A, 74B, 74C, 74D, and 74E, of the beam and then outward toward the surface being cleaned through openings in the bottom of brush cups (not shown but also illustrated in U.S. Pat. No. 6,009,593). Gear guards 32A and 32B are attached to the brush support beam 22 and are identical in construction so as to be interchangeable on either side of brush support beam 22. A gear brush rotation indicator 44 is fixedly attached to shaft extension 29 (FIG. 5 of U.S. Pat. No. 6,009,593) of gear brush 25E.

Integral to and extending upward from the opposite lateral ends of brush support beam are "T" shaped rails 42 and 43. As best seen in FIG. 3, T-rails 42 and 43 are slidably received within vertical guide slots 46 and 47 integrally molded into the lower base modular housing 12 whereby brush assembly 20 may freely move or float in the vertical direction within the brush assembly cavity 48 of housing 12. As also shown in FIG. 3, gear brush rotation indicator 44 extends upward through opening 56 in the top 45 of brush cavity 48 of lower housing 12.

Figure 4:
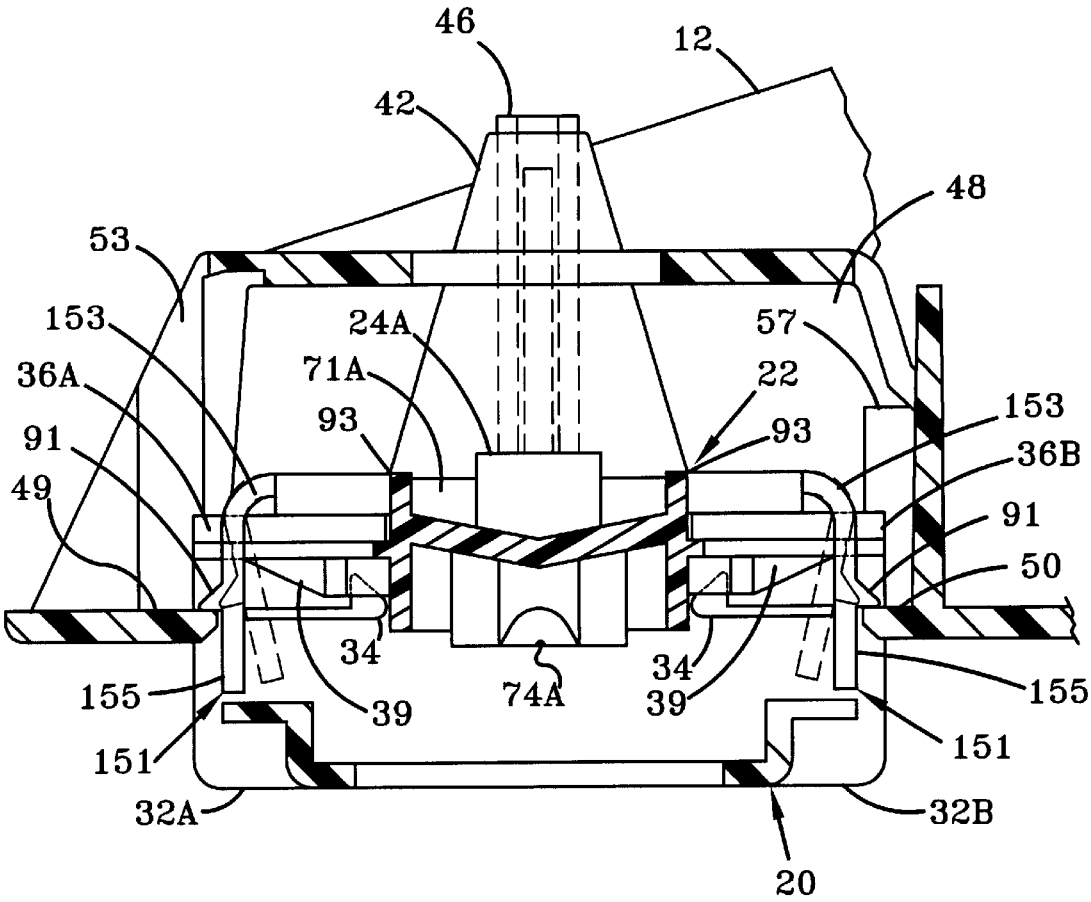
FIG. 4 is a sectional view as taken along line 4—4 in FIG. 3 with the brushes removed and the base module being lifted off the surface.

Referring to FIG. 4, to facilitate "snap together" assembly of each of the gear guards 32A, 32B to the brush support beam 22, each of the gear guards 32A and 32B is provided with three integrally formed, horizontally extending, locking tabs 34 extending parallel to and below the top cover plates 36A and 36B of gear guards 32A and 32B. Further, each gear guard (32A and 32B) is provided guide and alignment openings 38 (FIG. 2) for receipt therein (upon assembling the brush assembly) of extended tabs 39 of brush support beam 22. As the gear guards are brought together about brush support beam 22, tangs 34, on both gear guards 32A and 32B, slide under extended tabs 39, of brush support beam 22, engaging slots 41 (FIG. 5 of U.S. Pat. No. 6,009,593) thereby locking gear guards 32A and 32B to brush support beam 22.

A plurality of downwardly projecting tangs 151 extend from the top cover plates 36A and 36B of gear guards 32A and 32B, respectively as best seen in FIGS. 2 and 4. These figures illustrate that the tangs 151 are attached to the top cover plates 36A and 36B of gear guards 32A and 32B. However, it should be noted that the tangs 151 can be integrally formed with the top cover plates 36A and 36B of gear guards 32A and 32B. Each of the tangs 151 has one end 93 attached to the top cover plate 36A or 36B and the other end 95 extending freely. Each of the tangs 151 has a hook portion 91 located approximately midway between its ends, dividing the tang 151 into an upper portion 153 and a lower portion 155.

As depicted in FIG. 2, grooves 154 are formed in the side of the gear guards 32A, 32B directly across from the tangs 51 to provide more area for the tangs 151 to be flexed inwardly. A ledge 157 is provided on the bottom edge of each groove 154.

Referring to FIG. 4, as brush assembly 20 is inserted into cavity 48, the tangs 151 on gear guards 32A and 32B snap into vertically elongated grooves or slots 53 and 57, respectively, of housing 12. The tangs 151 projecting from gear guard 32A slidingly engage vertical slots 53 of housing 12 and tangs 151 projecting from gear guard 32B slidingly engage slots 57 thereby floatingly retaining brush assembly 20 within cavity 48. A lower limit of brush assembly 20, as illustrated in FIG. 4, is controlled by the hook portions 91 of the tangs 151 which engage the bottom ledges 49 and 50 of slots 53, 57. Each hook portion 91 is located a distance from the free end 95 of the tang 151 to allow sufficient room between the hook portion 91 and free end 95 of the tang 151 for engagement by a user to flex the tang 151 inwardly, as shown by the phantom lines, and disengage the hook portion 91 from the bottom ledges 49, 50 of the slots 53, 57. The upper travel of brush assembly 20 is limited by abutment of the brush assembly 20 against the top portion 45 of cavity 48 as illustrated in FIG. 1.

To remove the brush assembly 20 from the cavity 48 illustrated in FIG. 4, a user (not shown) first grasps the brush assembly 20 with his hands such that the thumb is placed on the lower portion 155 of a tang 151 of gear guard 32A and a finger is placed on the lower portion 155 of the tang 151 of gear guard 32B. The user then flexes the tangs 151 inwardly to move them a sufficient distance to disengage the hook portions 91 from the bottom ledges 49, 50 of the slots 53, 57 as illustrated by the phantom lines of FIG. 4. The brush assembly 20 can then be pulled out of the cavity 48.

Because the tangs 151 are pressed near their free ends, the tangs require less force to move or flex them inwardly to remove them from the bottom ledges 49, 50 of slots 53, 57, respectively, than that of the tangs of previously mentioned U.S. Pat. No. 6,009,593.

The present invention has been described by way of example using the illustrated embodiment. Upon reviewing the detailed description and the appended drawings, various modifications and variations of the preferred embodiment will become apparent to one of ordinary skill in the art. All such obvious modification and variations are intended to be included in the scope of the present invention and of the claims appended hereto. For example, the tangs 151 could be attached to the lower housing 12 of the base module 10 and the slots 53, 57 could be formed in the gear guards 32A and 32B.

In view of the above, it is intended that the present invention not be limited by the preceding disclosure of a preferred embodiment, but rather be limited only by the appended claims.

What is claimed is:

1. A cleaner for cleaning a surface comprising:

a main body;

a brush assembly for engaging said surface being cleaned;

an engaging member on one of said main body and said brush assembly;

a retaining portion on the other one of said main body and said brush assembly, said engaging member and said retaining portion being releasably connected to each other;

one of said engaging member and said retaining portion is accessible for engagement by a user to disengage said engaging member from said retaining portion, said engaging member includes an outwardly projecting tang extending from one of said main body and said brush assembly, said tang having one of its ends attached to said one of said main body and said brush assembly and the other end extending freely;

said tang having a hook portion located between said ends, said hook portion engaging said retaining portion to support said brush assembly;

said retaining portion includes a slot, said slot having a bottom end, said tang being slidably received in said slot such that said hook portion engages said bottom end to support said brush assembly; and wherein said hook portion is located a distance from said free end of said tang to allow sufficient room between said hook portion and said free end for engagement by a user to move said tang to disengage said hook portion from said bottom end of said slot.

2. A cleaner for cleaning a surface comprising:

a main body having a plurality of slots;

a brush assembly for engaging said surface being cleaned;

a plurality of outwardly projecting tangs extending from said brush assembly, each of said tangs having one of its ends attached to said brush assembly and the other end extending freely;

each of said tangs having a hook portion located between said ends;

each of said slots having a bottom end, said tangs being slidably received in said slots such that said hook portions engage said bottom end to support said brush assembly; and wherein said hook portion is located a distance from said free end of said tang to allow sufficient room between said hook portion and said free end for engagement by a user to move said said tang to disengage said hook portion from said bottom end of said slot.

3. A cleaner according to claim 2, wherein said brush assembly includes a brush support beam carrying said brushes, a gear guard received upon, and partially surrounding said beam, said gear guard having an upper portion, said tangs extending downwardly from said upper portion of said gear guard.

4. A cleaner according to claim 3, including a groove formed in said gear guard opposite said tang.

5. A cleaning device for cleaning a surface in which cleaning solution is dispensed to the surface and substantially simultaneously extracted along with the dirt on the surface in a continuous operation comprising:

a main body for movement along a surface;

a recovery system mounted to said main body and comprising:

a suction nozzle for transporting liquid and dirt from said surface;

a liquid distribution system for dispensing liquid to said surface;

a brush assembly having a plurality of pliable elements for engaging said surface being cleaned;

an engaging member on one of said main body and said brush assembly;

a retaining member on the other of said main body and said brush assembly, said engaging member and said retaining member being releasably engaged to each other to releasably retain said brush assembly to said main body; one of said engaging member and said retaining member includes a part depending downwardly from said one of said main body and said brush assembly, said part having a lower end extending freely and accessible for engagement by a user to disengage said engaging member from said retaining member.

6. The cleaning device of claim 5 wherein said brush assembly has a rotating brush.

7. The cleaning device of claim 6 wherein said brush assembly is positioned rearwardly from said suction nozzle.

8. The cleaning device of claim 7 including a brush guard mounted to said brush assembly, said part being integrally formed with said brush guard.

9. The cleaning device of claim 8 wherein said rotating brush includes a gear portion, said brush guard including a gear guard portion at least partially covering said gear portion.

10. The cleaning device of claim 5 wherein said brush assembly includes a plurality of rotating brushes.

11. The cleaning device of claim 5 wherein said brush assembly is positioned rearwardly from said suction nozzle.

12. The cleaning device of claim 5 including a brush guard mounted to said brush assembly, said part being integrally formed with said brush guard.

13. The cleaning device of claim 12 wherein said part has an upper end integrally formed with said brush guard.

14. The cleaning device of claim 12 wherein said brush assembly includes a plurality of rotating brushes.

15. The cleaning device of claim 14 wherein rotation of a first brush causes rotation of a second brush.

16. The cleaning device of claim 15 wherein each of said rotating brushes includes a gear portion, said brush guard including a gear guard portion at least partially covering said gear portions of said rotating brushes.

17. The cleaning device of claim 5 wherein said engaging member is on said brush assembly, said retaining member being on said main body, wherein said engaging member includes said part.

* * * * *